United States Patent [19]

Mair et al.

[11] Patent Number: 4,593,480

[45] Date of Patent: Jun. 10, 1986

[54] PAPER DEFLECTION ROLLER FOR A PRINTER OR COPIER MEANS FUNCTIONING ON THE PRINCIPLE OF ELECTROPHOTOGRAPHY

[75] Inventors: Eduard Mair; Siegfried Zoeke, both of Munich, Fed. Rep. of Germany

[73] Assignee: Siemens Aktiengesellschaft, Berlin & Munich, Fed. Rep. of Germany

[21] Appl. No.: 573,000

[22] Filed: Jan. 23, 1984

[30] Foreign Application Priority Data

Feb. 7, 1983 [DE] Fed. Rep. of Germany ..... 3304068

[51] Int. Cl.[4] ..... F26B 13/14

[52] U.S. Cl. ..... 34/78; 34/152; 34/153; 34/157; 29/121.2; 29/132; 118/68; 118/DIG. 15; 428/906

[58] Field of Search ..... 34/78, 152, 153, 157; 29/121.2, 121.3, 121.8, 132; 118/67, 68, DIG. 15; 428/377, 906; 430/97, 124; 432/8, 59, 246

[56] References Cited

U.S. PATENT DOCUMENTS

| | | | |
|---|---|---|---|
| 2,162,947 | 6/1939 | Gleeson | 29/121.2 |
| 2,287,768 | 6/1942 | Eckstein | 29/121.2 |
| 3,487,517 | 1/1970 | Douglas | 29/121.2 |
| 3,595,539 | 7/1971 | Kimura et al. | 263/6 E |
| 3,786,549 | 1/1974 | Pott | 29/132 |
| 4,264,304 | 4/1981 | Hausmann | 432/59 |
| 4,372,246 | 2/1983 | Azar et al. | 29/132 |
| 4,439,144 | 3/1984 | Mair | 432/59 |

FOREIGN PATENT DOCUMENTS

| | | | |
|---|---|---|---|
| 746226 | 8/1970 | France | 29/132 |
| 2009886 | 6/1979 | United Kingdom . | |
| 2011031 | 7/1979 | United Kingdom . | |

*Primary Examiner*—Albert J. Makay
*Assistant Examiner*—David W. Westphal
*Attorney, Agent, or Firm*—Hill, Van Santen, Steadman & Simpson

[57] ABSTRACT

A paper web recording medium provided with toner images as conducted through a fixing housing containing solvent vapor over a paper deflection drum for fixing the toner images on the recording medium. The paper deflection drum is formed by a rigid roller body made of expanded or foamed plastic over which an elastic grid network fabric of toner-repellent material is drawn as an exterior surface sleeve. A low-mass paper deflection roller having low thermal conductivity is thus provided, so that no solvent vapor can condense at the surface of the fixing drum. The low-mass structure of the paper deflection drum also prevents a smear print when starting or stopping conduct of the paper web through the fixing housing.

9 Claims, 3 Drawing Figures

PAPER DEFLECTION ROLLER FOR A PRINTER OR COPIER MEANS FUNCTIONING ON THE PRINCIPLE OF ELECTROPHOTOGRAPHY

BACKGROUND OF THE INVENTION

The invention relates to a fixing station assembly for fixing toner images produced on a recording medium and, more particularly, to a roller or drum construction for guiding a recording medium provided with toner images through a fixing station housing containing solvent vapor in copying or printing devices.

So-called fast paper printers or copiers typically function according to the principle of electrophotography. A toner image is produced on a recording medium, such as a paper web, and, then, the images are fixed upon employment of a dry toner process. Fixation may be effected by exposing the toner to a solvent vapor in a fixing station such as disclosed in U.S. Pat. No. 4,264,304 and U.S. Pat. No. 4,439,144. The recording medium provided with the toner image is continuously conducted in the form of a taut loops over deflection rollers and a fixing drum in a housing containing the solvent vapor. The rollers serve to steer the recording medium, typically a paper web, through the fixing station, the paper web being transported via driven conveyor means disposed outside of the fixing station. A heating element disposed at the bottom or floor of the fixing housing heats liquid solvent and thus causes it to vaporize. The solvent vapor influences the recording medium with the toner image, to dissolve the toner so that this can adhere to the surface of the recording medium. In order to reduce losses of solvent vapor, cooling coils are typically disposed in an upper area of the fixing housing. A large part of the rising solvent vapor then condenses in the area of the cooling coils and is thus retained in the housing.

During printing pauses in which no fixing occurs, it is expedient to remove the recording medium from the zone of high vapor concentration in order to avoid undue moistening due to solvent vapor. This is accomplished by movement of the drum so that the recording medium is wholly disposed in the upper area of the cooling coils. During fixing, the fixing drum is disposed beneath the cooling coils in the area of the solvent vapor.

When the recording medium is held in the cooled area adjacent the condensing coils, the fixing drum itself necessarily is cooled, especially when located there for a long time. When the printing mode is resumed and the fixing drum is lowered into the area of the solvent vapor, solvent vapor unavoidably condenses on the surface of the fixing drum until its temperature rises above the dew point of the vapor. Vapor condensing on the drum is soaked up by the recording medium moving across the fixing drum and, hence, is transported out of the fixing housing with the recording medium. Thus, increased losses of solvent occur and disruptions of the printed image as a result of too great an influence of the solvent soaking through from the back surface of the recording medium occur.

Another problem with previously known fixing station constructions is that printing may smear as the result of starting and stopping the printer or copier means. Print smearing can occur when the circumferential speed of the drum and deflection rollers differs from the conveying speed of the paper web. The smear print deteriorates the quality of the print image over the entire line width.

The toner image situated on the paper is fixed on the paper by means of a solvent vapor upon traversal of the fixing station. This occurs by means of etching the toner image. The toner image etched by the fixer vapor in turn requires a certain time in order to convert from its pasty condition into its solid condition. The toner image side of the paper lies against the surface of a paper discharge roller as it departs the fixing station over this paper discharge roller. It can thereby occur that toner particles that are still pasty adhere to the surface of the paper discharge roller. Given further revolutions of the discharge roller, these toner particles are then transferred to the paper web as an indirect print. This indirect print, often referred to as "offset print" is superimposed on the original print image in a disturbing fasion.

It is already known to electrically heat the fixing drum in order to avoid producing condensation spots given introduction and removal of the fixing drum into/from the zone of high vapor concentration inside the fixing station. This, however, requires a high outlay in assembly costs. German Pat. No. OS 30 48 477 (its counterpart U.S. Ser. No. 319,727, filed Nov. 9, 1981 now abandoned) discloses the employment of a wire helix wrapped about the cylindrical surface of the fixing drum to divert condensate toward the end faces to avoid condensation spots; however, this device is not effective in instances where there is relatively high solvent vapor concentration in the station.

An object of the invention is to afford paper deflection rollers and drums for guiding and deflecting the recording medium in a printer means fixing station with which smearing of the print image no longer occurs when deflecting the recording medium and unsuitable condensation is avoided on the fixing drum.

SUMMARY OF THE INVENTION

A paper deflection roller or drum for guiding recording medium, typically paper web, through a fixing station of an electrographic printing device is formed of a roller body made of foam plastic material having a grid-shaped mesh exterior surface structure made of toner-repellent material. The roller body thus exhibits low mass and moment of inertia and the grid structure forms narrow raised for lifting the paper off the roller body surface, exposed as depressions between the grid network on the surface of the roller.

In that the surface of the paper deflection roller exhibits a grid-shaped, mesh-like structure made of ink or toner-repellent material, disruptions of the print image cannot occur at the points of contact of the structure and the recording medium. Since the roller body is formed of a low-density material such as, for example, a foamed plastic, print smearing cannot occur as a result of the low mass and the low moment of inertia of the paper deflection roller. The paper deflection roller has a very low thermal capacity combined with a very low thermal conductivity, so that problems regarding dew on the fixing drum and, thus, the deterioration of the print image due to condensate spots can no longer occur. The low mass moment of inertia resulting from employment of expanded plastics in the construction of the paper deflection roller prevents a smear print. The exterior grid structure, which is in the form of a synthetic fabric sleeve, increases the mechanical scuff resistance of the roller surface and thus lengthens the service life of the paper deflection roller. Further, so-called "offset printing" is thereby prevented since the print image now rests against the grid structure only in a punctiform fashion.

DESCRIPTION OF THE PREFERRED EMBODIMENT

Figure 1:
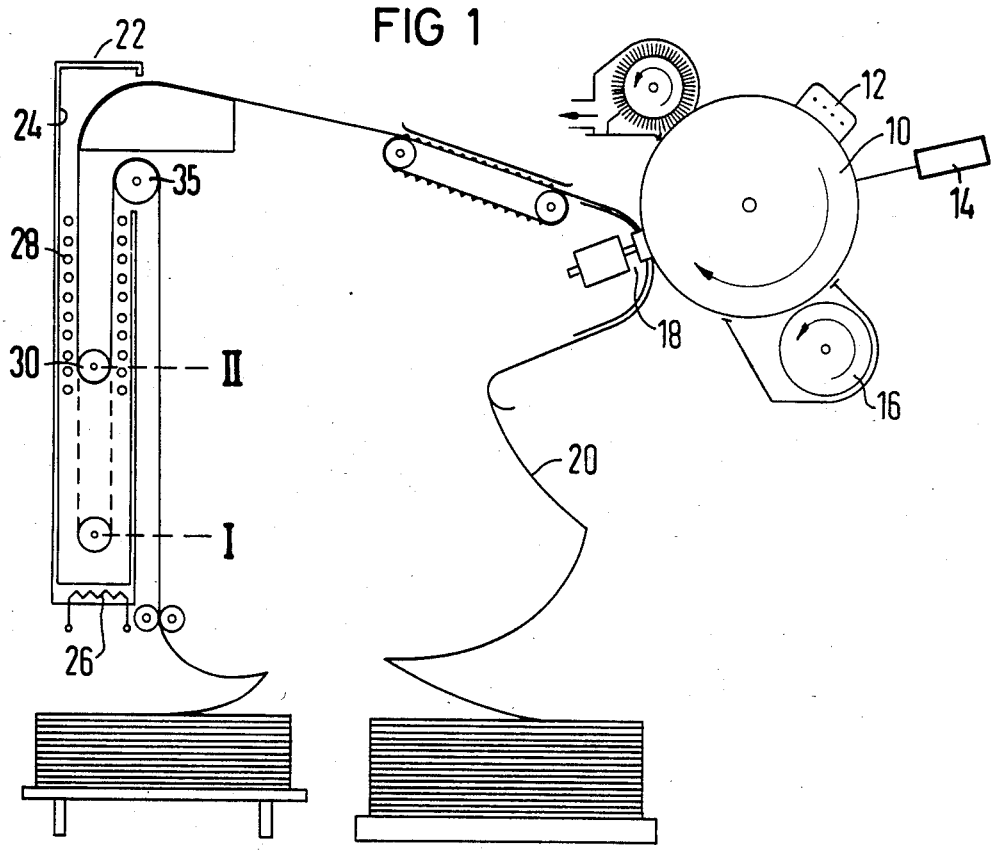
FIG. 1 is a schematic diagram of an electrophotographic printer means having a fixing station in which fixing is carried out with the assistance of solvent vapor.

FIG. 1 illustrates generally the features of an electrophotographic printer. A rotary sensitization drum 10 having a photoelectric surface is uniformly charged with ions sprayed onto the surface from a Corona discharge element 12. Charge images of the characters to be printed are generated on the drum 10 via a character generator 14, such as controlled light beam from a laser. The charge images are developed on the drum surface at a developer station 16, such as by use of a magnetic brush application of toner to the drum surface. The toner attaches to the charge images on the surface of the drum.

Subsequent rotation of the drum brings the drum surface to a transfer station 18, where the toner images of the characters to be printed, which are now disposed on the surface of the drum 10, are transferred to a recording medium 20, such as a paper web. The recording medium is conducted from a supply stack and through the transfer station 18 such that one surface or front side of the medium contacts the surface of the drum 10. From the transfer station 18, the recording medium 20 is conducted by suitable conveyor means to a fixing station 22.

The fixing station 22 is of a type which effects fixation of the print characters on the recording medium by exposing the recording medium to a solvent vapor. The fixing station 22 comprises a hollow housing 24 having a bottom or floor surface along which a heating element 26 is disposed. A supply of liquid solvent situated at the bottom of the housing 24 is vaporized as the result of heat given off by the element 26. In order to conserve solvent, an array of cooling coils 28 are disposed in the upper area of the housing 24 to condense the solvent vapor and prevent the emergence of solvent vapor from the fixing housing. The solvent vapor condensing in the area of the cooling coils 28 drips back to the bottom of the housing for re-vaporization.

The recording medium 20 is conducted through the housing 24 passing in reverse loops toward a collection stack trained about rotary, cylindrical deflection rollers, including a fixing drum 30 disposed for back and forth vertical movement within the chamber of the housing 24 and a discharge roller 35. During the fixing process, the fixing drum 30 is disposed adjacent the lower end of the housing 24 in the position I. There, the recording medium passes about the circumference of the drum 30 in an area where solvent vapor can influence the recording medium such that toner images adhere to the front surface of the medium 20. During printing pauses, when conduction of the recording medium through the fixing station 22 is stopped, it is expedient to remove the recording medium from exposure to the solvent vapor. To that end, the fixing drum 30 is moved upward toward the top of the housing 24 and into an area adjacent the cooling coils 28, such as shown by position II.

In the position II, the fixing drum 30 becomes cooled. such that, when the printing operation is resumed and the fixing drum 30 returns the recording medium to the position I, solvent vapor tends to condense at the surface of the fixing drum. Condensation of vapor on the drum occurs until the drum reaches a temperature above the vapor dew point.

If the recording medium 20 is permitted to be conducted directly over the annular surface of the fixing drum 30, then, at times when the drum is moved from position II to I, the recording medium soaks up condensate forming on the surface of the drum 30 and transports the collected solvent out of the fixing housing 24, such that it cannot be conserved or recycled, and print clarity can deteriorate.

Figure 2:
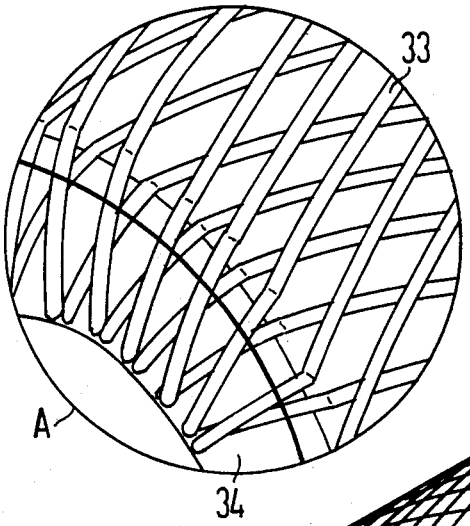
FIG. 2 is a sectionally magnified illustration (A) of the grid structure of FIG. 3.
Figure 3:
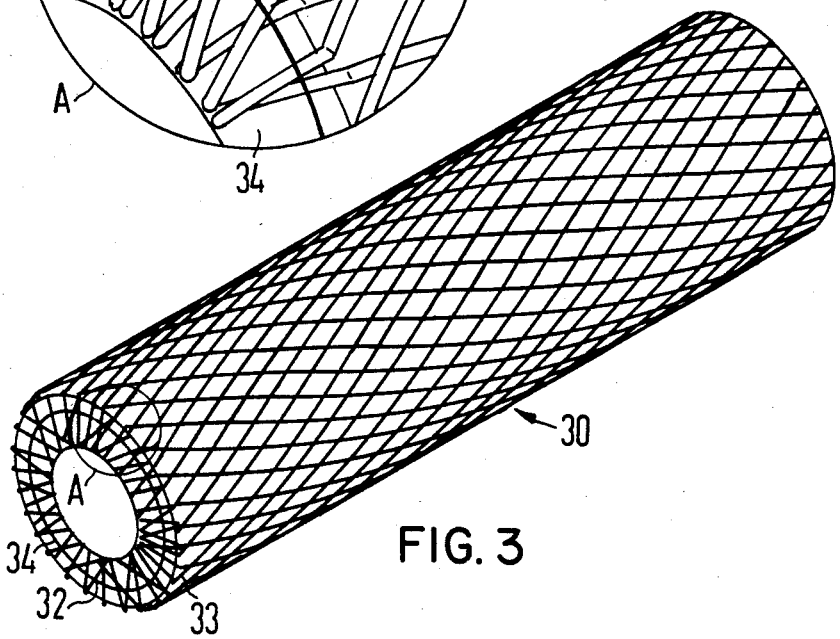
FIG. 3 is a perspective view of the inventive paper deflection roller construction.

In order to avoid this formation of condensate and for other above-described purposes, the fixing drum 30 as shown in FIG. 2 comprises a roller-shaped drum body 32 of polymethacrylimide foam (which is a rigid foam plastic) having a grid structure synthetic fabric sleeve 33 of polyethylene drawn over the drum body. This sleeve fabric is known in the packaging field and is typically drawn off hose-shaped from a reel and placed over the object to be packaged. As shown in the magnified FIG. 2 fragment, the synthetic fabric grid structure consists of synthetic threads disposed on top of one another in a criss-cross network.

The paper deflection roller means 30 and 35 are preferably manufactured in the same, simple manner. To this end, the synthetic net or fabric sleeve 33 is drawn onto the roller-shaped drum body 32 and cut off such that it laterally overlaps the edges of the drum body 32. As a consequence of the elasticity of the synthetic net 33, the overlapping areas of the synthetic net 33 radially contract to some degree. The projecting areas are then bonded to the end faces 34 of the drum body 32 via circular synthetic films of bondable material, for example polyethylene. Completely planar end faces 34 are thus produced.

Two exemplary embodiments of the paper deflection drum 30 have a diameter of approximately 40 and approximately 60 mm and a length of 400 mm. Their synthetic net 33 consists of single threads of about 5/10 mm and has a mesh width of 1 mm in its drawn-on condition on the drum body 32. The end faces of the drum body 32 consist of a circular polyethylene film that is bonded to the synthetic net under pressure at 120° C.

In further accordance with the invention, the synthetic material of the grid sleeve 33 is a toner-repellent synthetic or, alternatively, is coated with a toner-repellent synthetic, such as polyethylene.

It is also contemplated that the grid-shaped structure 33 can be directly impressed in the drum body instead of applying a hose-shaped synthetic fabric. In such case, the topical regions of the grid coming into direct contact with the recording medium would have a toner-repellent surface.

Although various minor modifications may be suggested by those versed in the art, it should be understood that we wish to embody within the scope of the patent warranted hereon all such modifications as reasonably and properly come within the scope of my contribution to the art.

We claim as our invention:

1. A deflection roller for guiding a recording medium applied with toner through a printing device fixing station housing containing solvent vapor and having a cooling coil means disposed adjacent an upper end of said housing and a heater for evaporating liquid solvent into vapor adjacent a lower end of said housing, comprising a cylindrical roller body made of lightweight plastic material on which is a grid-network mesh structure, in the form of an individual synthetic fabric sleeve fitted over said roller body, providing narrow raised lines enclosing open area depressions bottomed by the exterior surface of said roller body such that said recording medium is supported on said raised lines at a free space distance away from said roller body, such that said deflection roller means has low mass, a low mass moment of inertia, and very low thermal conductivity for high speed operation while avoiding solvent vapor dewing on said deflection roller means.

2. The deflection roller of claim 1, wherein said sleeve is made of toner-repellent material.

3. The deflection roller of claim 2, wherein said roller body is made of a foamed plastic material.

4. The deflection roller of claim 1, wherein said sleeve overlaps the opposed lateral edges of said roller body and is bonded to the opposed end faces of said roller body.

5. The deflection roller of claim 1, wherein said roller body is made of foamed polymethylacrylimide and said grid-network mesh structure is made of polyethylene.

6. A device for fixing toner powder images applied to a recording medium by means of a solvent vapor by guiding said recording medium about a deflection roller means disposed in an open top housing containing solvent vapor and having a cooling coil means disposed adjacent an upper end of said housing and a heater for evaporating liquid solvent into vapor adjacent a lower end of said housing, said deflection roller means having a cylindrical roller body made of lightweight plastic material disposed for rotation in said housing and a grid-network mesh structure, in the form of an individual synthetic fabric sleeve disposed about said roller body defining narrow raised lines of toner-repellent material enclosing open area depressions bottomed by the exterior surface of said roller body, said recording medium being supported on said raised lines at a free space distance away from said roller body, such that said deflection roller means has low mass, a low mass moment of inertia, and very low thermal conductivity for high speed operation while avoiding solvent vapor dewing on said deflection roller means.

7. The device of claim 6, wherein said roller body is made of foamed polymethylacrylimide and said grid-network mesh structure is made of polyethylene.

8. The device of claim 6, wherein said roller body is made of a foamed plastic material.

9. The device of claim 8, wherein said roller body is made of foamed polymethylacrylimide and said grid-network mesh structure is made of polyethylene.

* * * * *